United States Patent [19]

Sicard

[11] 4,242,972

[45] Jan. 6, 1981

[54] COMBUSTION SYSTEM WITH PARTIAL RECIRCULATION OF EXHAUST GASES AND FEED MECHANISM THEREFOR

[76] Inventor: Guy Sicard, 4, rue Coursol, Neufchatel, Québec, G2B 2H5, Canada

[21] Appl. No.: 972,332

[22] Filed: Dec. 22, 1978

[51] Int. Cl.[3] ..... F23B 7/00

[52] U.S. Cl. ..... 110/234; 110/104 R; 110/105; 110/205; 110/206; 110/216

[58] Field of Search ..... 110/204, 205, 206, 207, 110/102, 104 R, 105, 216, 234; 122/17, 51, 58 FB; 431/115, 116

[56] References Cited

U.S. PATENT DOCUMENTS

| | | | |
|---|---|---|---|
| 708,240 | 9/1902 | Mace | 110/205 |
| 916,910 | 3/1909 | Boersig | 110/205 |
| 1,504,528 | 8/1924 | Strandrud | 110/102 |
| 2,228,751 | 1/1941 | Bros | 110/102 |
| 2,357,899 | 9/1944 | Kohout | 110/105 |
| 3,610,182 | 10/1971 | Stockmas | 110/102 |
| 3,824,937 | 7/1974 | Turner et al. | 110/102 |
| 3,865,053 | 2/1975 | Kolze et al. | 110/102 X |
| 4,027,602 | 6/1977 | Mott | 110/216 X |

*Primary Examiner*—Edward G. Favors

[57] ABSTRACT

A combustion system for particulate wood waste, coal, peat and other combustible materials is disclosed. The system comprises means for feeding combustion material into the combustion chamber of a furnace and means for recirculating a portion of the exhaust gases from the furnace back into the combustion chamber for increasing the temperature of the combustion chamber and so improve the thermal efficiency of the furnace.

5 Claims, 3 Drawing Figures

COMBUSTION SYSTEM WITH PARTIAL RECIRCULATION OF EXHAUST GASES AND FEED MECHANISM THEREFOR

This invention relates to a particulate wood waste or carbon dust combustion system.

BACKGROUND OF THE INVENTION

The wood waste or carbon dust combustion systems presently on the market are based on a controlled mixture of air and combustion products. However, the thermal efficiency of such known systems is generally low due to incomplete combustion and this causes considerable emission of unburnt particles in the air. Therefore, the known systems are becoming inadequate due to more severe anti-pollution regulations.

SUMMARY OF THE INVENTION

It is therefore the object of the present invention to provide a combustion system which permits to increase the combustion temperature in the combustion chamber of a furnace, thus improving the thermal efficiency and the completeness of combustion.

The combustion system, in accordance with the invention, comprises a means for feeding combustion material into the combustion chamber of a furnace and a means for recirculating a portion of the exhaust gases and suspended particles from the furnace back into the combustion chamber for increasing the temperature of the combustion chamber and thus improving the thermal efficiency of the furnace and completing the combustion of the suspended particles.

The means for feeding the combustion material into the combustion chamber preferably comprises a particulate material storage container having tapered bottom wall portions, a mixer located in the storage container for agitating the particulate waste material to prevent arching, a conveyor screw located in the tapered bottom wall portion of the container for feeding the waste material to a vertical discharge duct, a rotary valve located in such vertical discharge duct for controlling the feed of waste material through the duct, and to prevent blow back from the combustion chamber in the event of an increase in pressure, and an impeller located at the base of the duct for projecting the combustion material into a conduit leading into the combustion chamber.

The feed conduit is preferably directed upwardly and in a direction opposite to the normal flow of combustion gas in the furnace to promote turbulence and to accelerate ignition.

The means for recirculating a fraction of the exhaust gases back into the combustion chamber preferably comprises a blower located in a derivation circuit, a manifold duct communicating with the derivation duct, and a plurality of combustion chamber air inlets connected to the manifold for feeding back a portion of the exhaust gases to the combustion chamber. A recuperator of suspended particles is also preferably located in the derivation circuit between the blower and such manifold.

SHORT DESCRIPTION OF THE DRAWINGS

The invention will now be disclosed, by way of example, with reference to a preferred embodiment in which.

Figure 1:
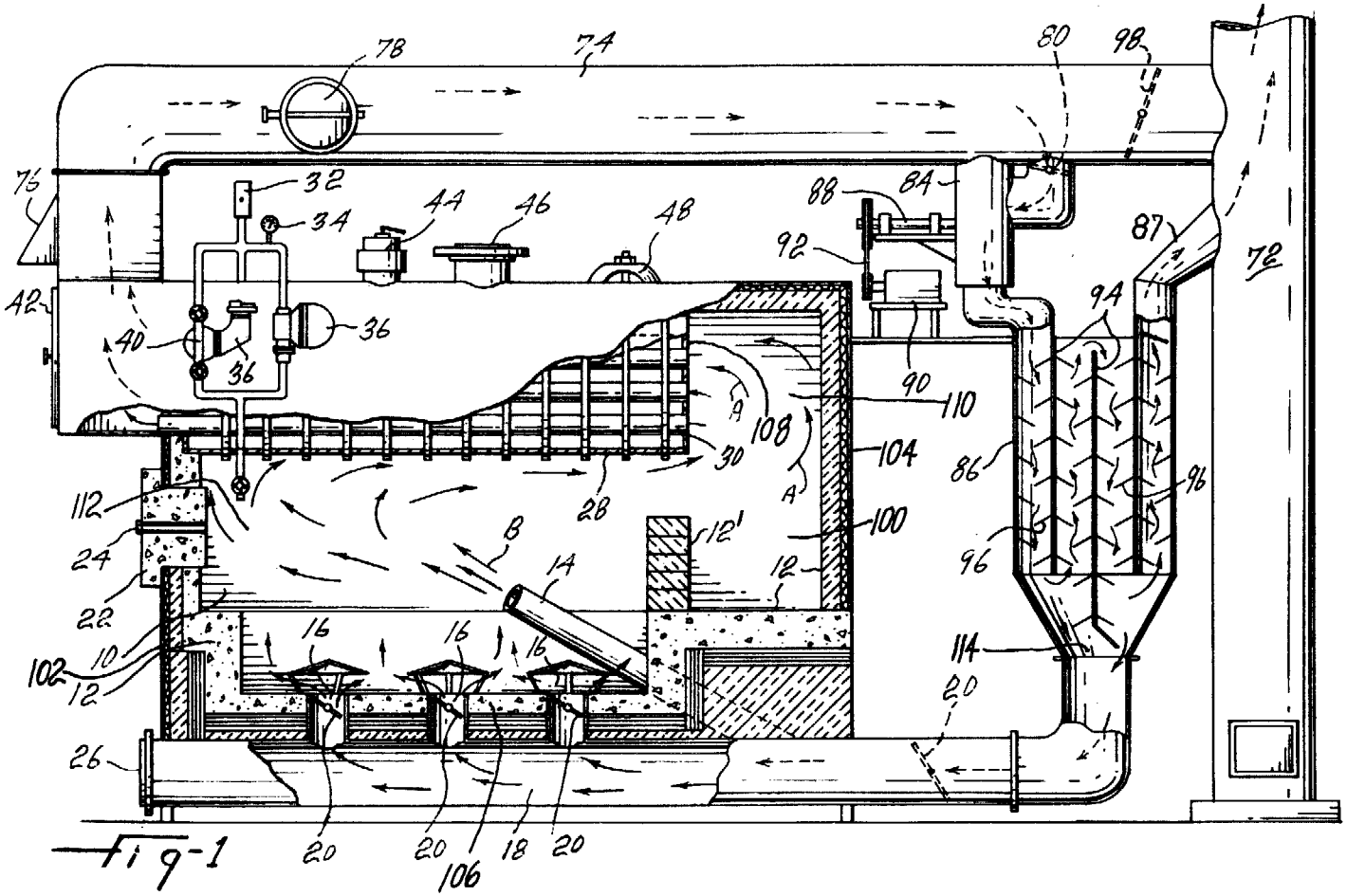
FIG. 1 illustrates a particle section view through a furnace in accordance with the invention.

Referring to the drawings, there is shown furnace comprising a combustion chamber 10, the inside of which is lined with refractory material, bricks 12 or a water jacket. Combustion chamber 10 includes side walls 100, a front wall 102, a back wall 104, and a bottom wall 106. The combustion material together with primary combustion air is fed into the furnace through a feed duct 14 whereas recycled combustion gas and secondary combustion air is fed through inlets 16 protruding through the bottom wall 106 of the combustion chamber and communicating with a manifold 18. The flow of gas through the manifold and the individual inlets 16 is controlled by dampers 20. A door 22 is provided at the front wall 102 for providing access to the combustion chamber. An inspection window 24 is also located in the centre of the door for viewing the inside of the furnace during the operation thereof. The manifold 18 is closed at the front of the furnace by a door 26 which gives access to the manifold for cleaning when needed.

Figure 2:
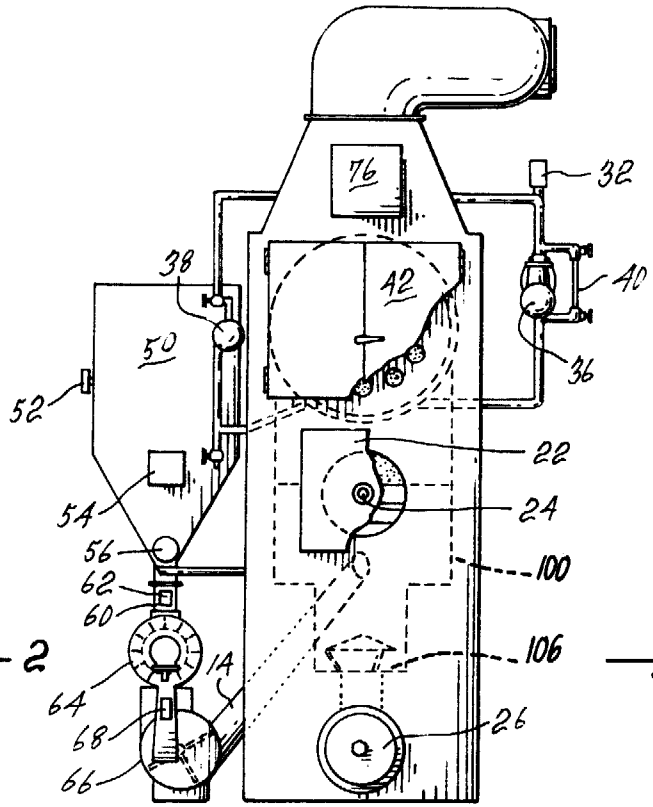
FIG. 2 illustrates an end view of the furnace in accordance with the invention.

In the top portion of the combustion chamber is the boiler tank 28 provided with a plurality of fire tubes 30 through which flows the combustion gases as indicated by arrows "A". The rear end wall 108 of boiler tank 28 and the inlets of fire tubes 30 are spaced forwardly of back wall 104, so as to define a rear combustion chamber portion 110 therewith. The major portion 112 of the combustion chamber is located underneath boiler 28 and communicates with rear combustion chamber portion 110 by a restricted passage defined by a partition wall 12' upstanding from bottom wall 106, aligned with the rear end wall 108 of boiler 28 and terminating short of the latter. Referring to FIGS. 1 and 2, feed duct 14 extends through a wall of the combustion chamber and has an inner straight portion exposed within the major portion 112 of the combustion chamber. Said inner straight portion has a discharge end located intermediate boiler 28 and bottom wall 106 and forwardly of combustion chamber rear portion 110. The inner straight portion of feed duct 14 is directed upwardly and forwardly, and also transversely, of the combustion chamber, so that the flow of primary air and particulate fuel are directed towards the side wall 100 and towards boiler 28 and front wall 102. The water pressure in the boiler tank is regulated by pressure control 32 and indicated by pressure gauge 34. Low water cut-off valves 36 are also provided on the side of the boiler tank in conventional manner. Also provided is a low water supply valve 38. The level of the water in the boiler tank may be checked through glass tube 40. Door 42 gives access to the boiler tank. A high pressure safety valve 44 and a vapor outlet 46 are provided on the top of the boiler tank. Finally, a trap 48 provides access to the top of the boiler tank.

Figure 3:
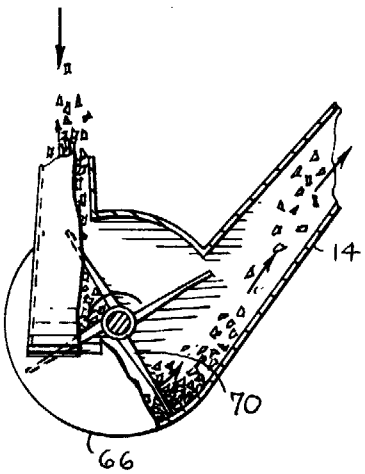
FIG. 3 illustrates an enlarged view of the impeller used to propel the particulate feed material into the furnace.

The particulate fuel which consists of particulate wood waste, coal dust, peat or other particulate fuel, is stored in a container 50. The level of particulate fuel in the container is controlled in known manner, by a level sensor 52. The fuel in the container is continuously agitated by an agitator illustrated schematically by reference 54. The bottom portion of the storage container is tapered and a screw conveyor illustrated schematically by reference numeral 56, is provided for feeding the particulate fuel to a vertical discharge duct 60 provided with an inspection window 62. A motor-driven rotary valve 64 is located in the discharge duct 60 to control the amount of particulate fuel passing through the duct, and to prevent any blow back from the combustion chamber in the event of an increase in pressure. The particulate fuel is thrown into the combustion chamber by an impeller 66. An air inlet 68 is also located in the duct 60 between the rotary valve and the impeller for providing primary combustion air to the combustion chamber. As shown more clearly in FIG. 3, the impeller consists of four blades 70 powered by an electric motor (not shown). It will be noted that primary air is fed and that the particulate fuel is thrown into the combustion chamber upwardly and in a forwardly and transversely inclined direction "B" which is opposite to the flow of combustion gases to promote turbulence and accelerate ignition.

The exhaust gases of the furnace are fed to a chimney 72 through an exhaust or flue duct 74 which communicates with the fire tube outlet at the front wall of the boiler 28. Exhaust duct 74 is provided with the conventional emergency air inlet valve 76 and draft valve 78. The latter supplies secondary air to the gas circuit. Normally the mixed secondary air and the exhaust gases, as controlled by a valve 80, are pumped by a blower 84 through a recuperator 86 of suspended particles. Blower 84 is mounted on a shaft 88 and powered by a motor 90 for instance through belt 92. The recuperator 86 comprises an elongated vertically-disposed housing provided with a plurality of vertical partitions 94 which define a zigzag path for the gas and suspended particles flowing through the recuperator. Partitions 94 define straight vertical path portions disposed side by side and communicating end to end in series. The first path portion is fed by blower 84, while the last path portion communicates with chimney 72 through duct 87. Housing 86 has a bottom outlet 114 which communicates with manifold 18. Partitions 94 extend downwardly short of bottom outlet 114, so that all of the path portions communicate with the latter. Each partition 94 and the inside walls of the recuperator are provided with downwardly inclined baffles or fins 96 partially obstructing the path portions to promote turbulence and trap the suspended particles in the combustion gases.

In accordance with a feature of the present invention, the trapped suspended particles and a major portion of the exhaust gases mixed with the secondary air (for instance 80% to 90% of the gas flow in flue duct 74) are returned back to the furnace through manifold 18 and the rest of the mixture is fed to the chimney through duct 87. The recirculation through the furnace of the hot mixture of combustion gases and secondary air permits to operate the furnace at a higher temperature and to obtain a more complete combustion. Also, the suspended particles are recirculated and burnt. It has been observed that the smoke coming out of the chimney is substantially cleaner with the combustion system in accordance with the invention indicating a substantially complete combustion. In addition, there are substantially no combustion residues left in the furnace, which is also a clear indication of improved combustion. A normally closed safety valve 98 is provided in the exhaust duct 74 for exhaust of the gases directly into chimney 72 in case of blocking of the recirculation circuit.

What I claim is:

1. A combustion system comprising a generally rectangular combustion chamber having side walls, front and back end walls, a bottom wall and a top wall, a fire tube boiler horizontally disposed in the top portion of said combustion chamber and which has its rear end wall spaced forwardly from said back wall, so as to define a rear combustion chamber portion disposed rearwardly of said boiler and in communication with the fire tube inlets opening at said rear end wall of of said boiler, a flue duct in communication with the fire tube outlets opening at the front end wall of said boiler, said boiler combustion chamber having a major portion located underneath said boiler, a particulate fuel feed conduit passing through a wall of said combustion chamber and having an inner straight portion exposed within said combustion chamber major portion and having a discharge end located underneath said boiler forwardly of said rear combustion chamber portion and intermediate said boiler and said bottom wall, said inner straight portion being directed upwardly forwardly towards said front wall and said boiler, means to feed primary air and means to throw particulate fuel into said combustion chamber major portion through said feed circuit, means to mix secondary air with the exhaust gases in said flue duct, means to separate suspended particles in the mixture of secondary air and exhaust gases in said flue duct, means to recirculate the separated particles and a portion of said mixture back into the combustion chamber, said last-named means including several inlets in said bottom wall of said combustion chamber, and means to discharge the remaining portion of said mixture into the atmosphere, said remaining portion being substantially free of suspended particles.

2. A combustion system as defined in claim 1, wherein said inner straight portion of said feed conduit extends also transversely of said combustion chamber major portion, so that the mixture of particulate fuel and primary air discharged from said feed conduit, is directed towards one of said side walls.

3. A combustion system as defined in claim 1 or 2, wherein the communication between said combustion chamber major portion and said rear combustion chamber portion is restricted by a partition wall upstanding from said bottom wall, in line with the rear end wall of said boiler and terminating short of said boiler.

4. A combustion system as defined in claim 1, wherein said means to separate said suspended particles includes an elongated vertical housing having a first outlet at its lower end in communication with said inlets in said bottom wall of said combustion chamber, a plurality of vertical partitions located in said housing and defining a zigzag path consisting of straight vertical path portions disposed side by side and communicating with each other end to end in series to direct the gases flowing therethrough downwardly and alternatively upwardly through said path portions, said partitions extending downwardly short of said first outlet, so that all of the path portions communicate with said first outlet, the first one of said path portions communicating with said flue duct and the last one of said path portions having an outlet for discharge to the atmosphere.

5. A combustion system as defined in claim 4, wherein all of said path portions are lined with downwardly-inclined baffles partially obstructing said path portions and promoting turbulence of the flowing gases and separation of the suspended particles.

* * * * *